United States Patent [19]

Wiedemann

[11] 3,982,937

[45] Sept. 28, 1976

[54] ELECTROPHOTOGRAPHIC RECORDING MATERIAL

[75] Inventor: Wolfgang Wiedemann, Geisenheim-Johannisberg, Germany

[73] Assignee: Hoechst Aktiengesellschaft, Germany

[22] Filed: July 12, 1974

[21] Appl. No.: 488,212

[30] Foreign Application Priority Data

July 16, 1973 Germany ..... 2336093

[52] U.S. Cl. ..... 96/1.5; 96/1.6

[51] Int. Cl.[2] ..... G03G 5/04

[58] Field of Search ..... 96/1.5, 1.6, 1.1, 1.2; 252/501

[56] References Cited

UNITED STATES PATENTS 3,546,085 12/1970 Weinberger et al. ..... 96/1 PE 3,725,058 4/1973 Hayashi ..... 96/1.5

FOREIGN PATENTS OR APPLICATIONS 763,540 8/1971 Belgium ..... 96/1.5

*Primary Examiner*—David Klein
*Assistant Examiner*—John L. Goodrow
*Attorney, Agent, or Firm*—James E. Bryan

[57] ABSTRACT

This invention relates to an article which comprises an electrically conductive carrier layer, a layer comprising a material selected from the group consisting of selenium or selenium-tellurium, and, on the side of the selenium or selenium-tellurium layer remote from the carrier layer, a layer comprising an oligomeric condensation product of 3-bromopyrene and formaldehyde having a degree of polycondensation of 6 to 10.

19 Claims, 4 Drawing Figures

Figure 1:
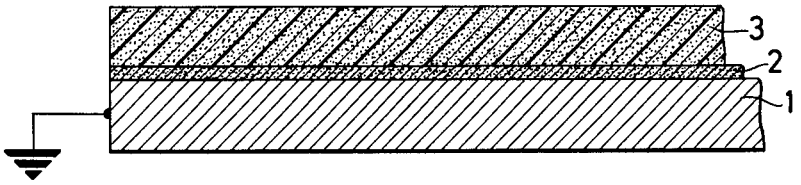

1/E1/2
1,0
0,8
0,5
0,2
0,1
0,05
0,01
400
500
600
700
λ
1
2

1/E1/2

1,0
0,8
0,5
0,2
0,1
0,05
0,01
1c
1b
2
1a
λ
400
500
600
700

ELECTROPHOTOGRAPHIC RECORDING MATERIAL

This invention relates to an article, suitable for use as electrophotographic recording material, comprising an electrically conductive carrier material, optionally provided with an intermediate layer, and a photoconductive layer.

It is known that a layer of an inorganic material such as selenium, selenium-tellurium, cadmium sulfide, or cadmium selenide having a thickness of less than 0.1 μm on an electrically conductive carrier material may act as a charge carrier injection layer for inorganic or organic charge carrier transport layers located above it. Proposals of this type have been made in German Pat. No. 1,022,091, German Auslegeschrift No. 1,277,016, and German Offenlegungsschriften Nos. 1,964,817, 2,128,584, 2,128,641, and 2,165,295.

Inorganic transport materials considered in the above-mentioned specifications are, above all, relatively thick layers of amorphous selenium. However, when using an inorganic charge carrier transport layer of, for example, selenium, special light exposure arrangements are necessary because of the opacity of this material. Furthermore, such materials are insufficiently flexible.

As regards organic photoconductors for a transport layer, a proposal has been made to use substances possessing a polymeric structure, especially polyvinyl carbazole or the halogenated derivatives thereof. However, it has been found that layers of such polymer compounds cannot be employed by themselves since they lack a certain flexibility, which is necessary for good adhesion. On the other hand, there is a limit to the extent to which the polymeric compounds can be blended with resin binders; this is because of the turbidity which results and because of the observed increased residual charge relative to the base material.

A proposal has also been made in German Offenlegungsschrift No. 2,108,938, to use not only polymeric compounds such as polyvinyl carbazole but also compounds such as poly-1-vinylpyrene, polymethylene pyrene and N-substituted polymeric acrylic acid amides of pyrene. The use of non-polymeric materials namely certain polycyclic aromatic compounds (alone or in mixtures) is also described. A disadvantage when using these substances is that the polymers, for example poly-1-vinylpyrene, can be manufactured only in several stages, and the inadequate reproducibility and solubility of polymethylene pyrene, which is obtained upon condensation of pyrene with formaldehyde. Since pyrene possesses more than two cross-linking positions, for example the 3-, 5-, 8- and 10-positions, the condensation reaction easily produces cross-linked products of varying solubility, thus making it impossible to obtain satisfactory reproducibility of the data. Furthermore, the polycyclic aromatic compounds readily tend to crystallize out if only minor amounts of binders are present, which permanently impairs the photosensitivity.

A proposal also has been made to use double layers by locating a photoconductive layer above an organic insulating resin layer on an electrically conductive carrier material in an electrophotographic image exposure system employing the reflection principle, with a positive charge (German Offenlegungsschrift No. 1,622,364). However, such a process is suitable only for use with very special copying apparatuses, since the exposure is made through the carrier material only. Furthermore, the very thin outer photoconductive layer causes severe wear of the photoconductor material.

Another previous proposal involves the use, on thick selenium layers, of very thin layers of an insulating resin binder and a material dispersed therein which causes photoconductivity, which layers operate under a positive charge for the purpose of extending the photosensitivity of the selenium into the red region of the spectrum (German Offenlegungsschrift No. 1,622,367). However, as a result of the provision of the thin outer layer, these photoconductor combinations suffer severely from mechanical abrasion so that they can be employed for an extremely limited time only.

The present invention provides an article which comprises an electrically conductive carrier layer, a layer comprising selenium or selenium-tellurium, and, on the side of the selenium or selenium-tellurium layer remote from the carrier layer, a layer comprising an oligomeric condensation product of 3-bromopyrene and formaldehyde having a degree of polymerization of 6 to 10. The selenium or selenium-tellurium layer and the layer comprising the condensation product form a photoconductive double layer, wherein the layer comprising the condensation product can function as a charge carrier transport layer. The various layers in the article of the invention preferably are continuous.

The invention makes it possible to provide highly photosensitive double layers which substantially overcome the disadvantages described above and are suitable for use in the xerographic copying process. The materials of the invention may be made from easily accessible substances which are readily compatible with other substances, have good adhesion between the various layers, and combine high mechanical stability with adequate flexibility. They can without difficulty be located on a cylindrical drum or be processed as a continuous strip without showing special wear phenomena, since they are, in particular, vary abrasion-resistant. Even when unavoidable wear of the outer layer takes place, the photoconductive double layer system is not substantially impaired since, though abrasion causes a slight decrease of the thickness of the charge carrier transport layer and hence of the chargeability, the photosensitivity increases as a result of the decrease in thickness. Accordingly, the electrophotographic recording material according to the invention is very particularly suitable for use in electrophotographic copying apparatuses. In contrast to the limited or involved means of obtaining the previously proposed arrangements and compounds, the invention, through using the compound which is easily accessible in accordance with U.S. Pat. No. 3,842,038, permits much broader applications.

Figure 2:
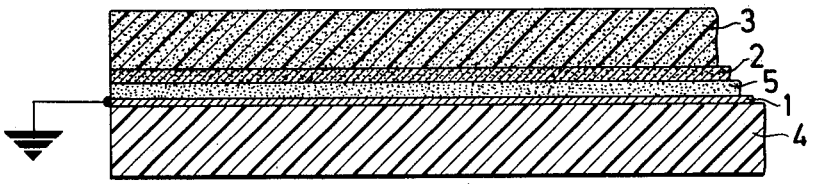

The construction of electrophotographic recording material according to the invention is shown, by way of example only, in FIGS. 1 and 2 of the accompanying drawings.

FIG.1 shows a material which is composed of an electrically conductive carrier layer 1, a vapor-deposited Se or Se/Te layer 2, and a charge carrier transport layer 3. In FIG. 2, a plastic layer 4 having a layer 1 of metal thereon is provided as the carrier layer, onto which is applied an intermediate layer 5 which prevents charge carrier injection in the dark. On top of this is applied a photoconductive double layer comprising a selenium or selenium/tellurium layer 2, and a charge carrier transport layer 3.

Suitable electrically conductive carrier materials include materials which previously have been proposed for this purpose. The carrier materials to be used according to the invention include, for example, aluminum foils and optionally transparent bases, for example plastic materials which have been vapor-coated or laminated with aluminum, gold, copper, zinc, cadmium, indium, antimony, nickel or tin. Quite generally, any carrier material which has been rendered sufficiently electrically conductive can be employed.

Optionally, an intermediate layer which comprises, for example, an organic material or a thermally-, anodically-, or chemically- produced metal oxide layer, for example an aluminum oxide layer, can be provided on the electrically conductive carrier material. The purpose of such an intermediate layer is generally to lower the charge carrier injection from the electrically conductive carrier material into the selenium layer. Furthermore, it may favorably influence the adhesion between the carrier material and the selenium layer. Instead, of, or in addition to, the oxide layers mentioned, materials which undergo little surface dissolution during the subsequent application of the transport layer may be used; these include, for example, polyamide resins and polyvinyl phosphonic acid. The thickness of an organic intermediate layer may be of the order of magnitude of about 1 $\mu$m while the thickness of a metal oxide intermediate layer may be of the order of magnitude of about $10^2$ to $10^4$ Angstrom units.

The layer of amorphous selenium, or of a mixture of selenium and tellurium, which is adjacent to the carrier material (or to the intermediate layer if one is present), advantageously has a thickness in the range of about 0.1 to about 2 $\mu$m, preferably from about 0.1 to about 1 $\mu$m.

The selenium, which is advantageously 99.999% pure, may be vapor-deposited in a vacuum of about $10^{-4}$ to about $10^{-6}$ mm Hg, from inductively heated quartz crucibles, at a temperature in the range of about 200 to about 280°C. When using such a method, the distance from the substrate, which is preferably maintained at a temperature below 40°C, is advantageously 15 to 35 cm. After opening the diaphragm device in the apparatus used, the formation of the homogeneous selenium layer may be followed by means of a thickness measuring instrument (for example QM 310, Film Thickness Monitor, Kronos Inc., Torrance, California). Good photosensitivity is achieved in the thickness range indicated above. If a layer of lesser thickness, for example less than 0.05 $\mu$m, is vapor-deposited, the photosensitivity decreases markedly. According to X-ray diffraction diagrams of vapor-deposited selenium layers, the selenium layer vapor-deposited in the above way is amorphous.

For the purpose of vaporizing selenium-tellurium, the flash vaporization method under appropriate subatmospheric pressure conditions has proved to be particularly advantageous. In this preferred method, a mixed phase preferably containing from about zero to about 45% by weight of tellurium is prepared and comminuted. The granular powder is introduced into a preheated crucible from whence immediate vaporization occurs. The thickness of vapor-deposited selenium-tellurium layers preferably also is within the above-mentioned range. The addition of tellurium to the selenium is of assistance because it broadens the sensitivity range of selenium in the red region of the spectrum, as is known, for example, from U.S. Pat. No. 2,745,327.

The charge carrier transport layer which is adjacent to the selenium or selenium-tellurium layer, has a high electrical resistance and prevents the dissipation in the dark of the electrostatic charge. Upon exposure to light, it transports the charges produced in the selenium or selenium/tellurium layer. Without the Se or Se-Te layer, it exhibits, in the visible spectral region of about 450 to 750 $\mu$m, a substantially lower photosensitivity.

The charge carrier transport layer may be applied by any suitable method, for example by centrifuging, coating, spraying, or dipping.

A limit is imposed on the drying conditions that may be used for the charge carrier transport layers because of a modification transformation of selenium at high temperatures. The temperature preferably should not exceed about 90°C if the dwell time of the double layer in the drying zone is only about 1 to 3 minutes.

The charge carrier transport layer used according to the invention comprises the oligomeric condensation product, which effects charge transport, and, optionally, a resin binder and/or an adhesion promoter. Any resin binder or adhesion promoter used is preferably chosen having regard to the charge transport, film properties, adhesion promotion and surface properties of the compound which effects charge transport. Furthermore, additional sensitizers or materials forming charge transfer complexes can be present. However, these should be employed only to the extent that the requisite transparency of the charge carrier transport layer is not impaired. Finally, further additives, for example levelling agents, plasticizers and adhesion promoters, also can be present.

Suitable compounds which effect charge transfer are above all organic compounds which have an expanded $\pi$-electron system. These include, according to the invention, oligomeric aromatic compounds. As such compounds the condensation products of formaldehyde and a pyrene having a substituent in at least one of the positions in which reaction can occur, preferably 3-bromopyrene, have proved particularly advantageous compared to the previously proposed pyrene, since, as a result of the blocking of one cross-linking position, they make possible linear methylene linkage of the pyrene molecules. The resulting oligomers having a degree of cross-linking in the range of $n = 6$ to 10 are distinguished by high elasticity and can be blended with binders in the charge carrier transport layers. They are easily accesible by the method described in German Offenlegungsschrift No. 2,137,288.

The oligomeric condensation product used as the electron donor compound in the materials of the invention, is preferably employed alone. However, it also can be used, if desired, in admixture with a resin binder (for example a hydrocarbon resin) and/or further additives. Preferable binders are copolymers of polyvinyl chloride and polyvinyl acetate such as Hostaflex M 131 (Farbwerke Hoechst AG) or VYHH, VMCH (Union Carbide Corporation). To increase the flexibility of charge carrier transport layers, a plasticizer, preferably a halogenated hydrocarbon (for example Hordaflex LC 50 or LC 60 of Farbwerke Hoeschst AG, or Aroclor of Monsanto, USA) or a Clophen resin of Bayer AG, may be employed.

When the charge carrier transport layer comprises a resin binder, the ratio in which the charge-transporting electron donor compound and the resin binder are mixed can vary. Because of the requirement that the maximum possible photosensitivity be obtained, however, a major proportion of the condensation product according to the invention is preferably used in the layer. A suitable mixing ratio is about 2 : 1 parts by weight. Advantageously, the proportion of resin is in the range of about 10 to 20% by weight, based on the weight of the resin/donor compound mixture. It has been found that increasing the proportion of certain resins used as binders increases the residual charge.

A sensitizer used in the charge carrier transport layer advantageously may assist the charge transport. In addition, it may produce charge carriers with the electron donor compound. As sensitizers it is possible to employ, for example, Rhodamine B extra, Schultz, Farbstoffabellen (Dyestuff Tables), volume I, 7th Edition, 1931, No. 864, page 365, Brilliant Green No. 760, page 314, Crystal Violet, No. 785, page 329, and Kryptocyanin, No. 927, page 397.

Compounds which form charge transfer complexes with the charge-transporting compound used according to the invention also can have the same type of effect as a sensitizer. By means of this, a further increase in the photosensitivity of the photoconductive layers of the invention can be achieved. The amount of the added sensitizers or of the compound which forms the charge transfer complex is so chosen that the resulting donor-acceptor complex, with its charge transfer band, is still sufficiently transparent for the purpose of the selenium or selenium/tellurium layer below it.

In addition to the requirement that the charge carrier transport layer be sufficiently transparent, the thickness of the layer also is an important parameter for optimum photosensitivity; layer thicknesses between about 5 and about 30 μm have proved to be suitable. Layer thicknesses between about 5 and about 15 μm are particularly advantageous. Quite generally, a lower maximum charge level must be expected at layer thicknesses below about 5 μm.

The materials of the invention make it possible to obtain a high charge coupled with low dark discharge. While with all previously proposed materials an increase in photosensitivity is coupled with an increase in the dark current, the present invention makes it possible to substantially overcome this difficulty. As a result, the materials of the invention can be used both in electrophotographic copying apparatuses of low copying speed and very low lamp energy and in electrophotographic copying apparatuses with high copying speeds and correspondingly higher lamp outputs.

The following Examples further illustrate the invention.

EXAMPLE 1

Solutions of 3-bromopyrene resin are applied to an amorphous vapor-deposited Se layer of 0.3 μm thickness which has been applied to a 50 μm thick polyester film vapor-coated with aluminum in such a way that, after the customary drying conditions (30 to 60 minutes at 60°C), layers approximately 5 to 10 μm thick are obtained. The 3-bromopyrene resin is obtained by condensation of 3-bromopyrene, melting point 94/5°C (Organic Synthesis, Vol. 48, 1968, St. 30) with formaldehyde in glacial acetic acid. After drying, a homogeneous glossy film, which adheres very well, is obtained.

The photosensitivity is measured as follows: The photoconductive layer travels, on a rotating disc, through a charging device (corona setting -6.0 kV, grid 1.1 kV) to an exposure station, where it is exposed to an XBO 150 xenon lamp of Messrs. Osram. A KG 3 heat absorption glass of Messrs. Schott u. Gen./Mainz, and a neutral filter of 15% transparency are placed in front of the lamp so that the light intensity in the plane of measurement is approximately 375 $\mu W/cm^2$. The charge level ($U_o$) and the photo-induced light decay curve are recorded oscillographically by means of a transparent probe, using a 610 CR electrometer of Messrs. Keithley Instruments, USA. The photoconductive layer is characterized by the charge level ($U_o$) and the time ($T_{1/2}$) after which half the charge ($U_{1/2}$) is reached. A material (zero layer) of analogous structure without a selenium layer is also measured for comparison. The following values are found:

| Bromopyrene resin thickness, μm | $-U_o$(V) | $T_{1/2}$(msec) | $\Delta U_D$ after 2 seconds |
|---|---|---|---|
| Approximately 5 | 650 | 10 | 120 |
| Approximately 10 | 850 | 21 | 120 |
| Approximately 10 (zero layer) | 525 | > 1,000 | |

The dark decay $\Delta U_D$ is measured in a Dyntest 90 instrument of Messrs. ECE, Giessen; after reaching the saturation voltage, the charge difference for the dark decay is determined after 2 seconds.

To determine the spectral photosensitivity of the 5 μm thick photoconductive double layer, the following procedure is used: the half-life ($T_{1/2}$, msec) for the particular wavelength range is determined, using a negative charge, by exposure to an XBO 150 xenon lamp, in front of which are placed monochromatic filters (line filters, halfwidth 10 to 12 nm, Schott u. Gen./Mainz) The spectral photosensitivity of the layer is obtained by plotting the reciprocal values of the product of the half-life, in seconds, and light intensity I, in $\mu W/cm^2$, against the wavelength λ in nm. The reciprocal value of $T_{1/2}$. I denotes the light energy, per unit area, which must be incident in order to discharge the layer to half the initial voltage U. The curve obtained is shown as curve 1 in FIG. 3 of the accompanying drawings.

Figure 3:
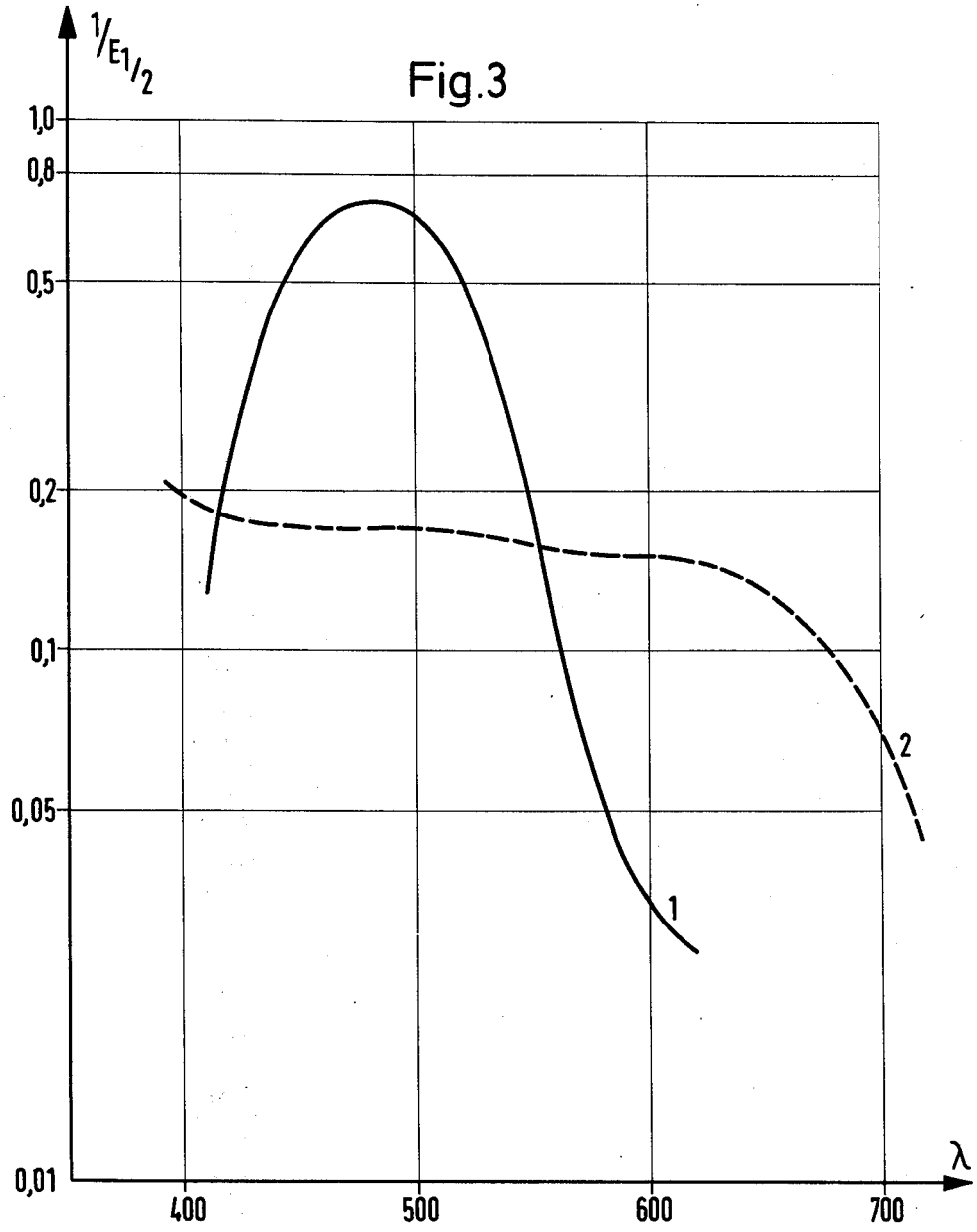

In addition, for comparison purposes, the spectral photosensitivity of an approximately 12 μm photoconductive layer of polyvinyl carbazole and 2,5,7-trinitrofluorenone-9 (molar ratio 1 : 1) according to U.S. Pat. No. 3,484,237, which meets high standards, is shown in FIG. 3 as curve 2.

EXAMPLE 2

A selenium-tellurium vapor-deposited layer containing 8% by weight of Te and having a thickness of 0.5 μm, on a 100 μm thick aluminum foil, is coated with a 15% solution of 22.5 parts by weight of the 3-bromopyrene resin described in Example 1 and 2.5 parts by weight of a plasticizer based on chlorinated hydrocarbons, for example Hordaflex LC 60 of Farbwerke Hoechst, in tetrahydrofuran as the solvent. The thickness of the top layer is approximately 10 μm after drying. The layer applied has excellent adhesion.

The photosensitivity, measured in accordance with the procedure of Example 1 and at I~340 $\mu W/cm^2$, is found to be 825 V in respect of the negative charge, and $T_{1/2}$ = 15 msec with regard to the half-life. The measurement of the dark decay, carried out according to Example 1, shows that $\Delta U_D$ after 2 sec = 70 V.

EXAMPLE 3

Se-Te vapor-deposited layers containing approximately 15% by weight of Te and having various thicknesses in the range of 0.1 to 0.5 μm, on 100 μm thick Al carrier foil, are uniformly coated with a 15% by weight solution of 3-bromopyrene resin in tetrahydrofuran as the solvent. After drying at 60°C for 30 minutes, homogeneous, welladhering double layers of approximately 10 μm thickness are obtained.

The photosensitivity of these layers is measured analogously to Example 1 at I~340 μW/cm²:

| Se/Te vapor-deposited layer, thickness (μm) | $-U_o$(V) | $T_{1/2}$(msec) | $\Delta U_p$ after 2 seconds |
|---|---|---|---|
| a) Approximately 0.1 | 1,000 | 54 | 110 |
| b) Approximately 0.3 | 1,000 | 20 | 120 |
| c) Approximately 0.5 | 1,050 | 21 | 160 |

Figure 4:
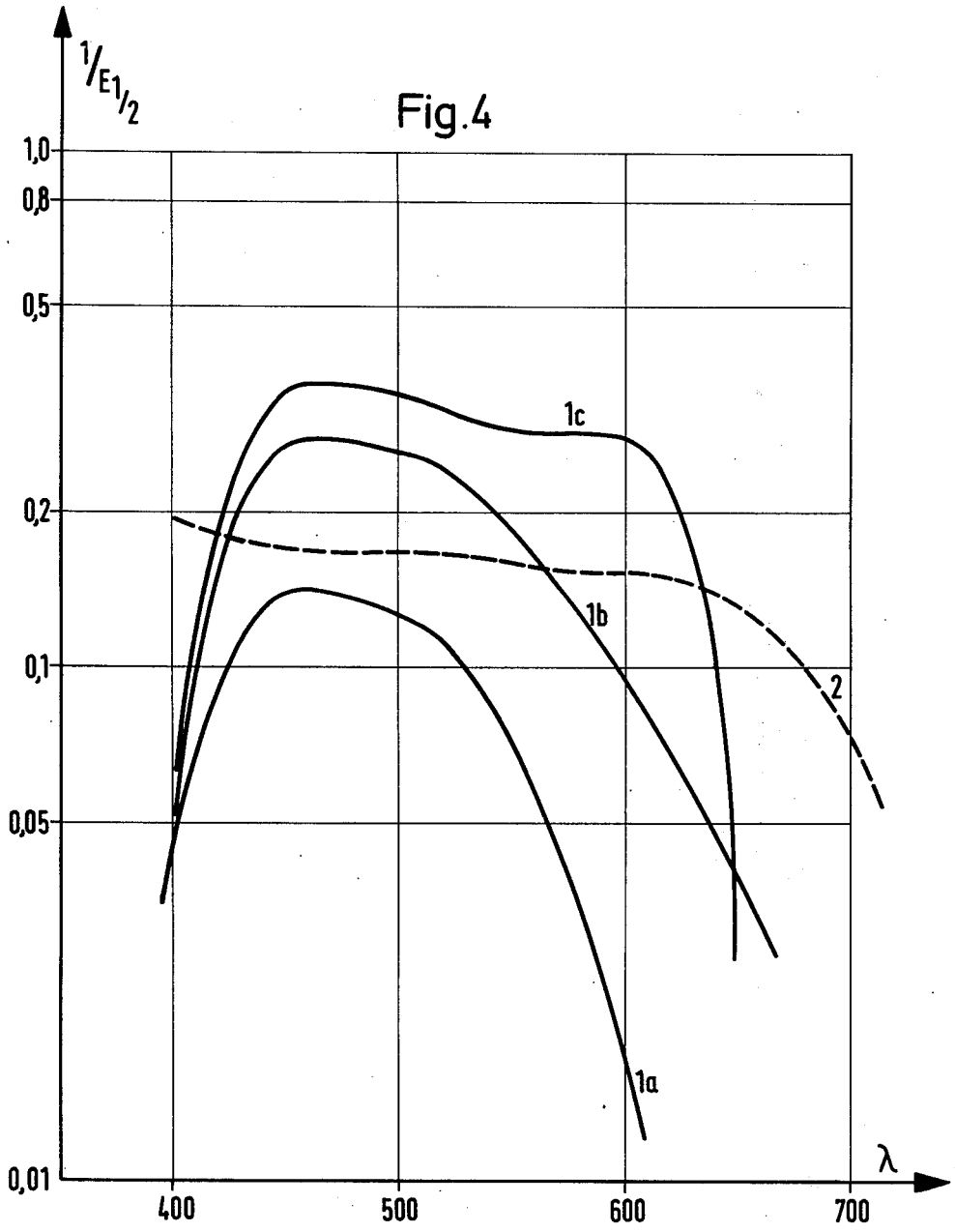

The spectral distribution of these layers was measured as in Example 1; the curves 1 a, b and c obtained are shown in FIG. 4 of the accompanying drawings. The comparison curve 2 in FIG. 4 was obtained in a similar manner to curve 2 in FIG. 3.

It will be obvious to those skilled in the art that many modifications may be made within the scope of the present invention without departing from the spirit thereof, and the invention includes all such modifications.

What is claimed is:

1. An article which comprises an electrically conductive carrier layer, a layer comprising a material selected from the group consisting of selenium or selenium-tellurium, and, on the side of the selenium or selenium-tellurium layer remote from the carrier layer, a layer comprising an oligomeric condensation product of 3-bromopyrene and formaldehyde having a degree of polycondensation of 6 to 10.

2. An article as claimed in claim 1 wherein the layer comprising the condensation product also includes a halogenated hydrocarbon plasticizer.

3. An article as claimed in claim 1 wherein the layer comprising the condensation product also includes a binder.

4. An article as claimed in claim 3 wherein about 2 parts by weight of the condensation product are present for every 1 part by weight of binder.

5. An article as claimed in claim 1 wherein the layer which comprises the condensation product also includes a sensitizer or a compound which can form a charge transfer complex with the condensation product.

6. An article as claimed in claim 1 wherein the layer which comprises the condensation product has a thickness in the range of about 5 to about 30 μm.

7. An article as claimed in claim 6 wherein the thickness is in the range of about 5 to about 15 μm.

8. An article as claimed in claim 1 wherein the thickness of the selenium or selenium-tellurium layer is in the range of about 0.1 to about 2 μm.

9. An article as claimed in claim 8 wherein the thickness is in the range of about 0.1 to about 1.0 μm.

10. An article as claimed in claim 1 wherein the selenium is 99.999% pure.

11. An article as claimed in claim 1 wherein the selenium or selenium-tellurium layer is a vapor-deposited layer.

12. An article as claimed in claim 1 wherein the carrier layer comprises aluminum foil.

13. An article as claimed in claim 1 wherein the carrier layer comprises a plastic material having a layer of aluminum, gold, copper, zinc, cadmium, indium, antimony, nickel or tin thereon.

14. An article as claimed in claim 1 which also comprises an intermediate layer between the carrier layer and the selenium or selenium-tellurium layer.

15. An article as claimed in claim 14 wherein the intermediate layer comprises an organic material.

16. An article as claimed in claim 15 wherein the thickness of the intermediate layer is about 1 μm.

17. An article as claimed in claim 14 wherein the intermediate layer comprises a metal oxide.

18. An article as claimed in claim 17 wherein the thickness of the intermediate layer is about $10^2$ to $10^4$ A.

19. Electrophotographic recording material composed of an electrically conductive carrier material and a photoconductive double layer of which the layer adjacent to the carrier material is composed of amorphous selenium or selenium/tellurium, and the layer adjacent to this layer contains an organic photodconductor, the charge carrier transport layer which is adjacent to the amorphous selenium or selenium/tellurium layer containing an oligomeric condensation product of 3-bromopyrene and formaldehyde having a degree of crosslinking $n = 6$ to 10.

* * * * *